US007204114B2

(12) United States Patent
Ni et al.

(10) Patent No.: US 7,204,114 B2
(45) Date of Patent: Apr. 17, 2007

(54) METHOD OF PROGRESSIVE HYDRO-FORMING OF TUBULAR MEMBERS

(75) Inventors: Chi-Mou Ni, Washington, MI (US); Edward J. Strzelecki, Oxford, MI (US)

(73) Assignee: General Motors Corporation, Detroit, MI (US)

( * ) Notice: Subject to any disclaimer, the term of this patent is extended or adjusted under 35 U.S.C. 154(b) by 434 days.

(21) Appl. No.: 10/650,202

(22) Filed: Aug. 28, 2003

(65) Prior Publication Data

US 2005/0044913 A1 Mar. 3, 2005

(51) Int. Cl.
*B21D 22/10* (2006.01)
*B21D 26/02* (2006.01)
*B21D 39/08* (2006.01)

(52) U.S. Cl. ..... 72/61; 72/370.22; 72/370.06

(58) Field of Classification Search ..... 72/370.22, 72/58, 61, 62, 57, 404, 416, 472, 370.1, 370.19, 72/370.21, 370.06
See application file for complete search history.

(56) References Cited

U.S. PATENT DOCUMENTS 1,899,288 A * 2/1933 Metcalf ..... 72/472
2,992,479 A 7/1961 Musser et al.
3,579,805 A 5/1971 Kast
4,765,359 A 8/1988 Burnett ..... 137/255
4,827,747 A * 5/1989 Okada et al. ..... 72/370.19
5,170,557 A * 12/1992 Rigsby ..... 72/61
5,333,775 A 8/1994 Bruggemann et al.
5,363,544 A * 11/1994 Wells et al. ..... 72/370.22
5,720,092 A 2/1998 Ni et al.
5,890,387 A * 4/1999 Roper et al. ..... 72/58
5,983,932 A 11/1999 Wagner et al. ..... 137/587
6,016,603 A * 1/2000 Marando et al. ..... 29/897.2
6,122,948 A * 9/2000 Moses ..... 72/61
6,183,013 B1 2/2001 Mackenzie et al.
6,241,310 B1 * 6/2001 Patelczyk ..... 296/205
6,386,009 B1 * 5/2002 Ni et al. ..... 72/61
6,474,534 B2 11/2002 Gabbianelli et al.
6,484,384 B1 11/2002 Gibson et al.
6,510,720 B1 * 1/2003 Newman et al. ..... 72/61
6,581,433 B2 * 6/2003 Otsuka et al. ..... 72/370.1
6,609,301 B1 8/2003 Morris et al.
6,654,995 B1 12/2003 Wang et al.
6,701,598 B2 3/2004 Chen et al.
6,739,166 B1 5/2004 Shah
6,766,678 B1 * 7/2004 Schulze et al. ..... 72/369
2003/0204944 A1 11/2003 Norek

* cited by examiner

*Primary Examiner*—Lowell A. Larson
*Assistant Examiner*—Teresa M. Bonk
(74) *Attorney, Agent, or Firm*—Lionel D. Anderson

(57) ABSTRACT

A method of progressive hydro-forming of a tubular member includes the steps of positioning a tubular member between open die halves mating with one another to define a first tubular cavity portion in a first stage. The method also includes the steps of progressively closing the die halves and applying hydraulic pressure to expand and conform the tubular member to the first tubular cavity portion in the first stage. The method includes the steps of positioning the expanded tubular member in a second tubular cavity portion in a second stage and progressively closing the die halves to progressively deform the expanded tubular member within the second tubular cavity portion. The method includes the steps of applying hydraulic pressure to expand and conform the expanded tubular member to the second tubular cavity portion in the second stage.

24 Claims, 3 Drawing Sheets

METHOD OF PROGRESSIVE HYDRO-FORMING OF TUBULAR MEMBERS

TECHNICAL FIELD

The present invention relates generally to forming a shaped tubular member and, more particularly, to a method of progressive hydro-forming of tubular members for automotive components.

BACKGROUND OF THE INVENTION

It is known to form a cross-sectional profile of a tubular member by a hydro-forming process in which a fluid filled tubular blank is placed within a die and then the die is closed so that the tubular blank is formed within the die. Fluid pressure is then increased inside the tubular member to expand the blank outwardly against the die cavity to provide a tubular component having a die formed cross-sectional profile. The tubular component may also have different cross-sectional profiles along the length thereof.

For an automotive component such as a fuel filler neck or manifold of a fuel fill system, the fuel filler neck and manifold are made with several pieces of deep drawn stampings and brazed together to form a leak-free tubular member of varying cross-section. This process results in a seam to be added so that the deep drawn stamping process could be used. However, the above-described hydro-forming process could not be used for the fuel filler neck and manifold because of the expansion requirements of the manifold sections.

As a result, it is desirable to provide a new method of hydro-forming a tubular member. It is also desirable to provide a method of hydro-forming a tubular member that allows smaller diameter tubes to be expanded significantly. It is further desirable to provide a method of hydro-forming a fuel filler neck or a fuel neck and manifold as one-piece. Therefore, there is a need in the art to provide a method of hydro-forming a tubular member that meets these desires.

SUMMARY OF THE INVENTION

It is, therefore, one object of the present invention to provide a new method of hydro-forming a tubular member.

It is another object of the present invention to provide a method of progressive hydro-forming of a tubular member.

To achieve the foregoing objects, the present invention is a method of progressive hydro-forming of a tubular member. The method includes the steps of providing a tubular member. The method also includes the steps of positioning the tubular member between open die halves mating with one another to define a first tubular cavity portion in a first stage. The method further includes the steps of progressively closing the die halves to progressively deform the tubular member within the first tubular cavity portion. The method includes the steps of applying hydraulic pressure to expand and conform the tubular member to the first tubular cavity portion in the first stage. The method also includes the steps of separating the die halves and removing the expanded tubular member from the first tubular cavity portion. The method also includes the steps of positioning the expanded tubular member between open die halves mating with one another to define a second tubular cavity portion in a second stage. The method further includes the steps of progressively closing the die halves to progressively deform the expanded tubular member within the second tubular cavity portion.

The method includes the steps of applying hydraulic pressure to expand and conform the expanded tubular member to the second tubular cavity portion in the second stage. The method also includes the steps of separating the die halves and removing the tubular member from the second tubular cavity portion.

One advantage of the present invention is that a method of progressive hydro-forming of a tubular member is provided for a vehicle component, such as a fuel filler neck and manifold. Another advantage of the present invention is that the method allows the use of smaller diameter tubes, resulting in less cost and mass. Yet another advantage of the present invention is that the method improves part quality, eliminating brazing seams and allowing improved part repeatability. Still another advantage of the present invention is that the method reduces tooling expense. A further advantage of the present invention is that the method can produce an integral one-piece part, thereby eliminating several pieces of deep drawn stampings that are brazed together.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
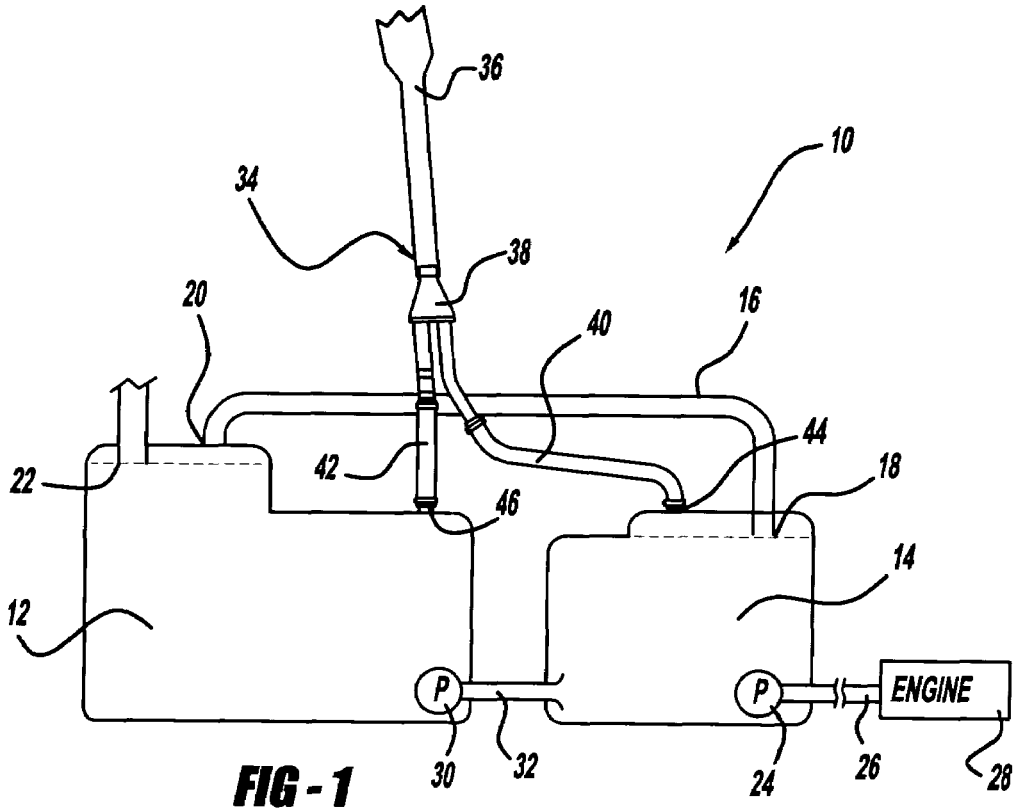
FIG. 1 is a diagrammatic view of a dual fuel tank simultaneous fill system incorporating a fuel filler neck and manifold made by a method, according to the present invention, of progressive hydro-forming of a tubular member.

Referring to the drawings and in particular FIG. 1, one embodiment of a dual fuel tank simultaneous fill system 10 is generally shown for a vehicle (not shown). The fill system 10 includes a first fuel tank 12 and a second fuel tank 14. The fill system 10 also includes a vapor relief line 16 fluidly connected to the first fuel tank 12 and the second fuel tank 14 from a first tank vent/overflow outlet 18 on the first fuel tank 12 to a second tank overflow inlet 20 on the second fuel tank 14. The fill system 10 includes a vapor relief outlet 22 connected to the second fuel tank 14 and vented to atmosphere.

The fill system 10 further includes a first pump 24 that draws fuel only from the first fuel tank 10 and delivers it via a line 26 to an engine 28 of the vehicle. The fill system 10 includes a second pump 30 that transfers fuel via a line 32 from the second fuel tank 14 to the first fuel tank 12. It should be appreciated that, as fuel is drawn from the first fuel tank 12, the second pump 30 transfers fuel from the second fuel tank 14 to the first fuel tank 12.

The fill system 10 includes a fuel filler neck and manifold assembly, generally indicated at 34, to fill the first fuel tank 12 and second fuel tank 14 simultaneously. The fuel filler neck and manifold assembly 34 includes a fuel inlet line or filler neck 36 and a flow-directing manifold connector 38 connected to the fuel filler neck 36. The manifold connector 38 has a generally "Y" shape to allow the first fuel tank 12 and second fuel tank 14 to be filled simultaneously. The fuel filler neck and manifold assembly 34 also includes a first tank branch line 40 interconnecting the manifold connector 38 and the first fuel tank 12 and a second tank branch line 42 interconnecting the manifold connector 38 and the second fuel tank 14. The first fuel tank 12 is fluidly connected to the first tank branch line 40 through a first tank inlet opening 44. The second fuel tank 14 is connected to the second tank branch line 42 by a second tank inlet opening 46.

Figure 6:
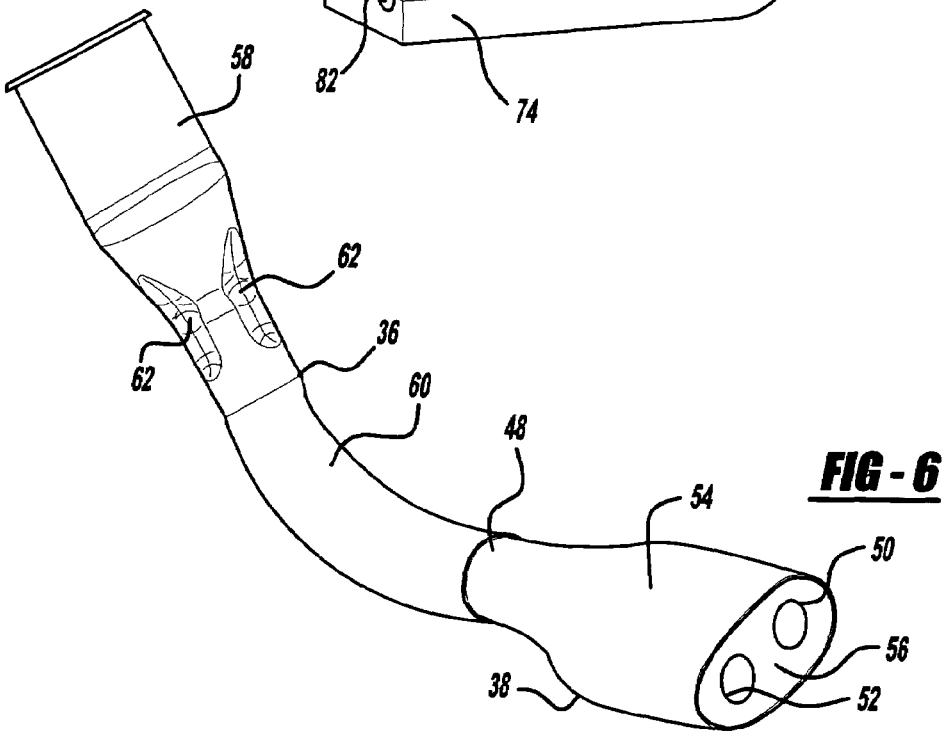
FIG. 6 is a perspective view of one embodiment of the fuel filler neck and manifold of FIG. 1, which has been progressively hydro-formed to a desired shape.

Referring to FIG. 6, the fuel filler neck 36 and the manifold connector 38 are formed as a monolithic structure, being integral, unitary, and one-piece. The manifold connector 38 includes an inlet port 48, a first outlet port 50, and a second outlet port 52. The manifold connector 38 also includes a manifold section 54 with the inlet port 48 at an upper end thereof, and the outlet ports 50, 52 depend from a lower, horizontal wall or end cap 56 of the manifold section 54. It should be appreciated that the first and second outlet ports 50 and 52 have substantially equal diameters.

The fuel filler neck 36 includes a fuel fill cup 58 and a bend neck 60 interconnecting the fuel fill cup 58 and the inlet port 48 of the manifold connector 38. The fuel fill cup 58 and bend neck 60 have a plurality of ribs 62 formed therebetween. Preferably, four ribs 62 are formed. It should be appreciated that fuel filler neck 36 and manifold connector 38 allow simultaneous filling of the first fuel tank 12 and second fuel tank 14 for a vehicle without premature nozzle shut-off and/or fuel spit-back under all operating conditions and fuel characteristics.

The fuel filler neck 36 and manifold connector 38 are formed by a method, according to the present invention, of progressive hydro-forming. The fuel filler neck 38 and manifold connector 38 are formed as a tubular member being integral, unitary, and one piece. The end cap 56 is formed with several steps of a stamping. The end cap 56 with the two outlet ports 50, 52 is then brazed to the hydro-formed fuel filler neck 36 and manifold connector 38. It should be appreciated that the first tank branch line 40 and second tank branch line 42 are joined to the manifold connector 38 by conventional means such as hoses and clamps.

Figure 2:
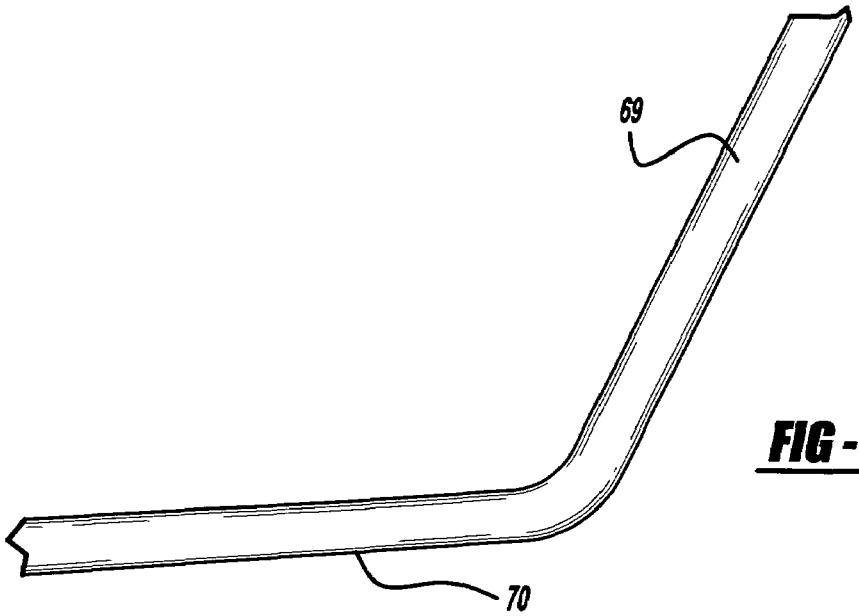
FIG. 2 is a perspective view of a pre-formed tubular member for the fill system of FIG. 1.

Referring to FIG. 2, a tubular blank or member is shown for use in carrying out a method, according to the present invention, of progressively hydro-forruing a tubular member such as the fuel filler neck 36 and manifold connector 38. The term "progressive hydro-forming" as used in this application means a two-stage die that enables a small tube to be expanded significantly. This two-stage die could be mounted to the press bed of a hydro-forming press. Alternatively, this two-stage die wit separate die cavities could be mounted in two separate presses. It should be appreciated that, although the method is described for the fuel filler neck and manifold connector 38, the method can be used for progressive hydro-forming of other tubular members for components such as exhaust systems.

The method includes the step of providing a tubular member 69. The tubular member 69 is made of a metal material. In one embodiment, the tubular member has a generally circular cross-sectional shape and extends axially. The method includes the step of bending the tubular member 69 to a predetermined position to form a pre-formed tubular member 70 with generally circular cross-sections. In the embodiment illustrated, the tubular member 69 has been bent to a predetermined position such as having a generally "L" shape through a suitable bending process such as mandrel bending, stretch bending, or die bending. It should be appreciated that the pre-formed tubular member 70, as illustrated, has the same diameter circular cross-section throughout its length. It should also be appreciated that an optimum diameter of the tubular member 69 is selected based on manufacturing and product needs.

Figure 3:
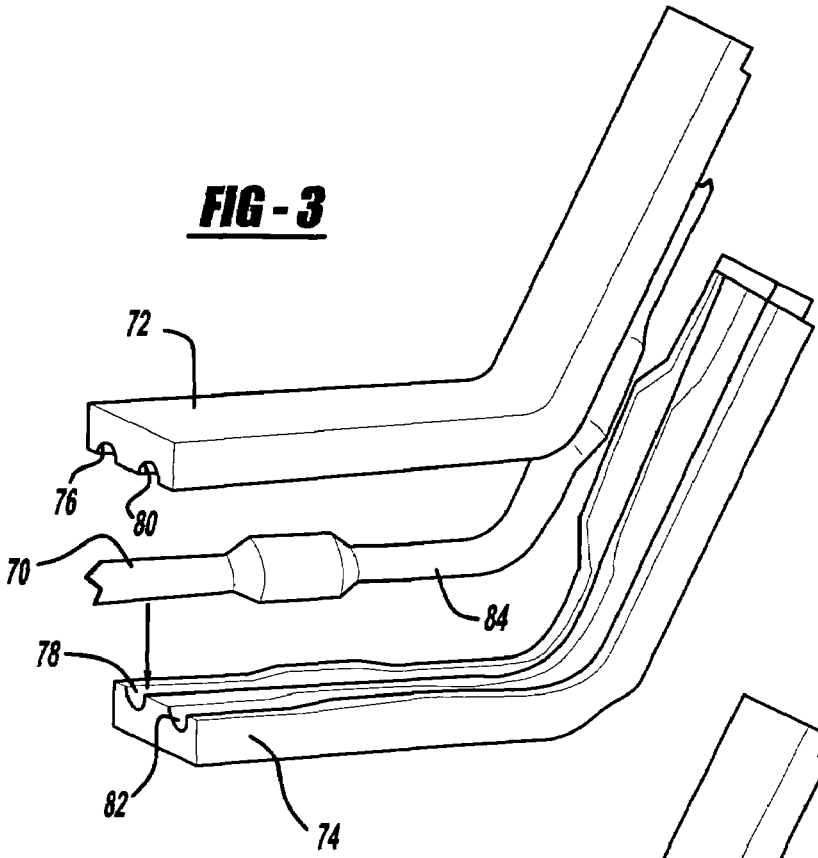
FIG. 3 is an exploded perspective view of the pre-formed tubular member of FIG. 2 placed between the halves of a die set and illustrating a first stage of progressive hydro-forming.
Figure 4:
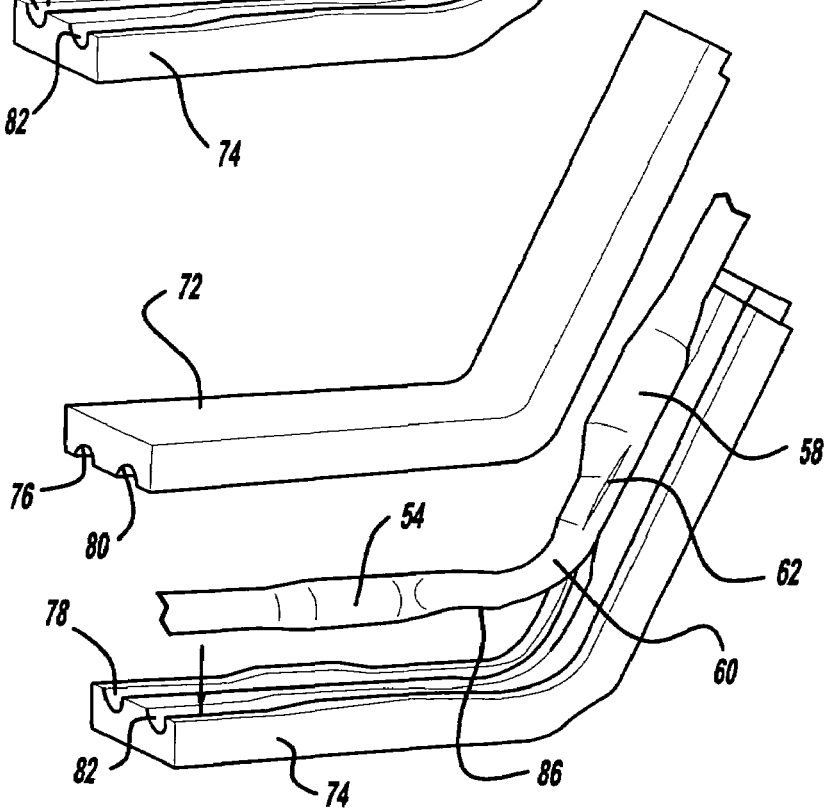
FIG. 4 is an exploded perspective view of the expanded tubular member of FIG. 3 placed between the halves of a die set and illustrating a second stage of progressive hydro-forming.
Figure 5:
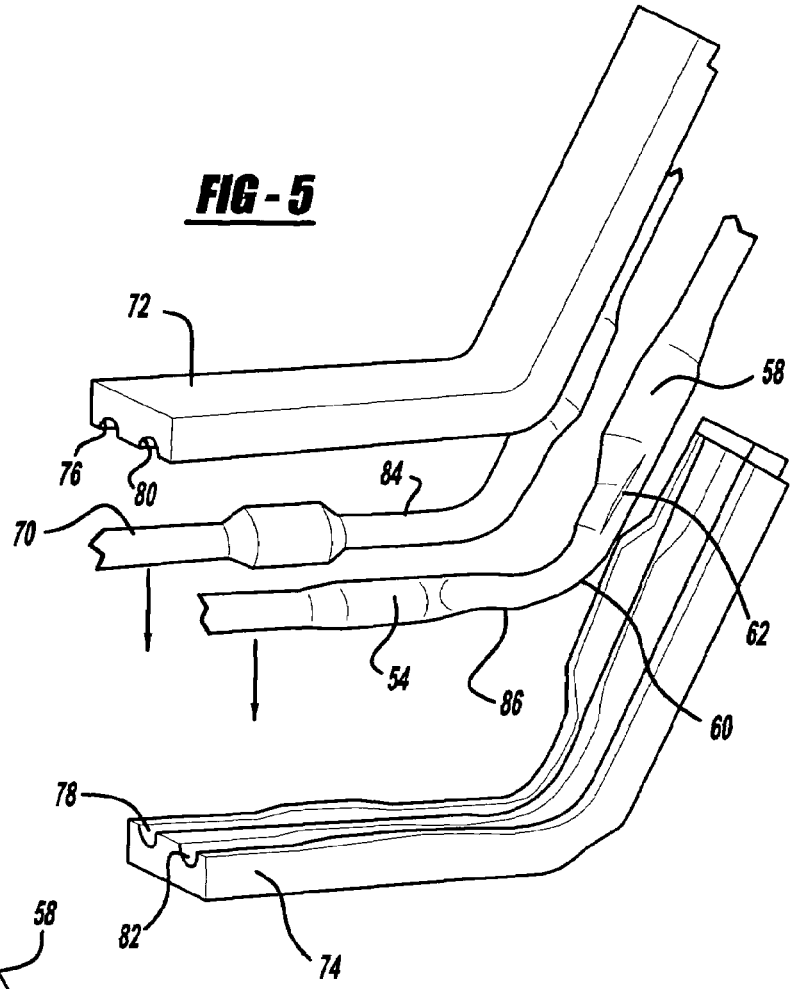
FIG. 5 is an exploded perspective view of the pre-formed tubular member and expanded tubular member of FIGS. 3 and 4 placed between the halves of a die set and illustrating the progressive hydro-forming.

Referring to FIGS. 3 through 5, the method includes the step of hydro-forming the pre-formed tubular member 70 to form a finished tubular member, which in the embodiment illustrated, is the fuel filler neck 36 and manifold connector 38. As illustrated in FIG. 3, the pre-formed tubular member 70 is placed in a die set comprised of an upper die half 72 and a lower die half 74. The upper die half 72 includes a first stage tubular forming cavity portion 76. Likewise, the lower die half 74 includes a first stage tubular forming cavity portion 78. The upper die half 72 includes a second stage tubular forming cavity portion 80. Likewise, the lower die half 74 includes a second stage tubular forming cavity portion 82. It should be appreciated that a combined cross-sectional circumferential measure of the first stage tubular forming cavity portions 76 and 78 total up to generally equal to or slightly greater than the cross-section perimeter length of the pre-formed tubular member 70.

In an actual hydro-forming operation, the pre-formed tubular member 70 and a pre-expanded tubular member 84 from the first stage of the die to be described are placed in the tool. The ends of the pre-formed tubular member 70 and the pre-expanded tubular member 84 are sealed. When the ends of the pre-formed tubular member 70 are sealed, hydraulic fluid is pumped into the pre-formed tubular member 70 under pressure. The upper die half 72 and lower die half 74 are closed so that the pre-formed tubular member 70 is progressively deformed and the pressurized fluid captured therein expands the walls of the pre-formed tubular member 70 into the first stage tubular forming cavity portions 76 and 78 of the die.

The die halves 72 and 74 are fully closed upon one another with the pre-formed tubular member 70 being tightly clamped between the die halves 72 and 74. During this closing of the die halves 72 and 74, a relatively constant hydraulic pressure may be maintained within the pre-formed tubular member 70 by incorporating a pressure relief valve (not shown) into the seal enclosing the ends of the pre-formed tubular member 70 so that hydraulic fluid may be forced from the pre-formed tubular member 70 as it collapses.

Once the die is closed, the pre-formed tubular member 70 is then expanded to a cross-sectional profile by increasing the hydraulic pressure sufficient to exceed the yield limit of the tubular member 70 so that the pre-formed tubular member 70 is forced into conformity with the first stage tubular forming cavity portions 76 and 78 of the die halves 72 and 74 to form a pre-expanded tubular member 84. The die halves 72 and 74 are then opened to permit progressive transfer of the expanded tubular member 84 from the first stage tubular forming cavity 78 into the second stage tubular forming 82. It should be appreciated that the first tubular forming cavity portions 76 and 78 create all the necessary expansions along the expanded tubular member 84. It should also be appreciated that, in this step of the method, the expanded round tubular sections are achieved through sectional expansion and some amount of material feeding at the ends of the tubular member.

The method also includes the step of moving the expanded tubular member 84 to the second stage tubular forming cavity portions 80 and 82 for final calibration to form a finished tubular member 86, which in this embodiment, is the fuel filler neck 36 and manifold connector 38 of FIG. 6. The method includes the step of positioning the expanded tubular member 84 between the second stage tubular forming cavities 80 and 82. The upper die half 72 and lower die half 74 are closed so that the expanded tubular member 84 is progressively deformed and the pressurized fluid captured therein expands the walls of the expanded tubular member 84 into the second stage tubular forming cavity portions 80 and 82.

Once the die halves 72 and 74 are closed, the expanded tubular member 84 is then expanded to a cross-sectional profile by increasing the hydraulic pressure sufficient to exceed the yield limit of the expanded tubular member 84 so that the expanded tubular member 84 is forced into conformity with the second stage tubular forming cavity portions 80 and 82 of the die halves 72 and 74. The die halves 72 and 74 are then opened to permit removal of the finished tubular member 86 from the die halves 72 and 74. It should be appreciated that the second stage tubular forming cavity portions 80 and 82 create the ribs 62 and ovalize the pre-expanded portions to form the bend and manifold sections 60 and 54.

The finished tubular member 86 may be machined to size and assembled into the fuel filler neck and manifold assembly 34. It should be appreciated that the die halves 72 and 74 are designed to provide the desired cross-sectional tubular shape. It should also be appreciated that the method is carried out, as illustrated in FIG. 5, with the pre-expanded tubular member 84 and finished tubular member 86 being progressively formed with the die halves 72 and 74. It should further be appreciated that the method can be carried out using one press for the die or two separate presses.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A method of progressive hydro-forming of a tubular member in a two-stage die, said method comprising the steps of:

providing a tubular member;

positioning the tubular member between open die halves mating with one another to define a first tubular cavity portion in a first stage of the two-stage die;

progressively closing the die halves to progressively deform the tubular member within the first tubular cavity portion;

applying hydraulic pressure to expand and conform the tubular member to the first tubular cavity portion in the first stage to create pre-expanded portions in the tubular member;

separating the die halves;

removing the expanded tubular member from the first tubular cavity portion;

positioning the expanded tubular member between open die halves mating with one another to define a second tubular cavity portion in a second stage of the two-stage die;

progressively closing the die halves to progressively deform the expanded tubular member within the second tubular cavity portion;

applying hydraulic pressure to expand and conform the expanded tubular member to the second tubular cavity portion in the second stage to ovalize the pre-expanded portions and to create ribs between a first section and a bend section of the expanded tubular member;

separating the die halves; and removing the final expanded tubular member from the second tubular cavity portion.

2. A method as set forth in claim 1 including the step of bending the tubular member to a predetermined position prior to said step of positioning in the first stage.

3. A method as set forth in claim 1 wherein said step of providing a tubular member comprises providing a tubular member having a generally circular cross-sectional shape.

4. A method as set forth in claim 1 wherein said step of applying comprises expanding at least one portion of the tubular member by fluid pressure.

5. A method as set forth in claim 1 wherein said step of applying includes the step of expanding at least one portion of the tubular member to have a size greater than a diameter of a remainder of the tubular member.

6. A method as set forth in claim 1 wherein said step of applying includes the step of expanding at least one portion of the tubular member to have a cross-sectional shape different from a cross-sectional shape of a remainder of the tubular member.

7. A method as set forth in claim 6 wherein the cross-sectional shape of the at least one portion is one of circular or oval.

8. A method as set forth in claim 1 wherein said step of applying comprises expanding at least one portion of the expanded tubular member by fluid pressure.

9. A method as set forth in claim 1 wherein said step of applying includes the step of expanding at least one portion of the expanded tubular member to have a size greater than a diameter of a remainder of the expanded tubular member.

10. A method as set forth in claim 1 wherein said step of applying includes the step of expanding at least one portion of the expanded tubular member to have a cross-sectional shape different from a cross-sectional shape of a remainder of the expanded tubular member.

11. A method as set forth in claim 10 wherein the cross-sectional shape of the at least one portion is one of circular or oval.

12. A method as set forth in claim 1 wherein the finished tubular member is integral, unitary, and one-piece.

13. A method as set forth in claim 1 wherein the tubular member is made of a metal material.

14. A method of progressive hydro-forming of a tubular member in a two-stage die, said method comprising the steps of:

providing a metal tubular member;

positioning the tubular member between open die halves mating with one another to define a first tubular cavity portion in a first stage of the two-stage die;

applying at least nominal internal hydraulic pressure to the tubular member;

progressively closing the die halves to progressively deform the tubular member within the first tubular cavity portion;

increasing the hydraulic pressure to expand and conform the tubular member to the first tubular cavity portion in the first stage to create pre-expanded portions in the tubular member;

separating the die halves;

removing the expanded tubular member from the first tubular cavity portion;

positioning the expanded tubular member between open die halves mating with one another to define a second tubular cavity portion in a second stage of the two-stage die;

progressively closing the die halves to progressively deform the expanded tubular member within the second tubular cavity portion;

increasing the hydraulic pressure to expand and conform the expanded tubular member to the second tubular cavity portion in the second stage to ovalize the pre-expanded portions and to create ribs between a first section and a bend section of the expanded tubular member;

separating the die halves; and removing the final expanded tubular member from the second tubular cavity portion.

15. A method as set forth in claim 14 including the step of bending the tubular member to a predetermined position prior to said step of applying.

16. A method as set forth in claim 14 wherein said step of providing a tubular member comprises providing a tubular member having a generally circular cross-sectional shape.

17. A method as set forth in claim 14 wherein said step of increasing includes the step of expanding at least one portion of the tubular member to have a size greater than a diameter of a remainder of the tubular member.

18. A method as set forth in claim 14 wherein said step of increasing includes the step of expanding at least one portion of the tubular member to have a cross-sectional shape different from a cross-sectional shape of a remainder of the tubular member.

19. A method as set forth in claim 18 wherein the cross-sectional shape of the at least one portion is one of circular or oval.

20. A method as set forth in claim 14 wherein said step of increasing includes the step of expanding at least one portion of the expanded tubular member to have a size greater than a diameter of a remainder of the expanded tubular member.

21. A method as set forth in claim 14 wherein said step of increasing includes the step of expanding at least one portion of the expanded tubular member to have a cross-sectional shape different from a cross-sectional shape of a remainder of the expanded tubular member.

22. A method as set forth in claim 21 wherein the cross-sectional shape of the at least one portion is one of circular or oval.

23. A method as set forth in claim 14 wherein the finished tubular member is integral, unitary, and one-piece.

24. A method of progressive hydro-forming of a tubular member in a two-stage die, said method comprising the steps of:

providing a metal tubular member;

bending the tubular member to a predetermined position to form a pre-formed tubular member;

positioning the pre-formed tubular member between open die halves mating with one another to define a first tubular cavity portion in a first stage of the two-stage die;

applying at least nominal internal hydraulic pressure to the pre-formed tubular member;

progressively closing the die halves to progressively deform the pre-formed tubular member within the first tubular cavity portion;

increasing the hydraulic pressure to expand and conform the pre-formed tubular member to the first tubular cavity portion in the first stage to create pre-expanded portions in the tubular member;

separating the die halves;

removing the expanded tubular member from the first tubular cavity portion;

positioning the expanded tubular member between open die halves mating with one another to define a second tubular cavity portion in a second stage of the two-stage die;

progressively closing the die halves to progressively deform the expanded tubular member within the second tubular cavity portion;

increasing the hydraulic pressure to expand and conform the expanded tubular member to the second tubular cavity portion in the second stage to ovalize the pre-expanded portions and to create ribs between a first section and a bend section of the expanded tubular member;

separating the die halves; and removing the final expanded tubular member from the second tubular cavity portion.

* * * * *